US008602826B2

(12) United States Patent
Zhang

(10) Patent No.: US 8,602,826 B2
(45) Date of Patent: Dec. 10, 2013

(54) ELECTRONIC CONNECTOR WITH DOUBLE INSERTING INTERFACES BACKGROUND

(75) Inventor: Shuai Zhang, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/598,649

(22) Filed: Aug. 30, 2012

(65) Prior Publication Data

US 2013/0090020 A1 Apr. 11, 2013

(30) Foreign Application Priority Data

Oct. 10, 2011 (CN) ..... 2011 1 0304548.1

(51) Int. Cl.
*H01R 24/00* (2011.01)

(52) U.S. Cl.
USPC ..... 439/660; 439/607.01

(58) Field of Classification Search
USPC ..... 439/607.01, 660
See application file for complete search history.

(56) References Cited

U.S. PATENT DOCUMENTS

| | | | | |
|---|---|---|---|---|
| 8,414,335 | B2 * | 4/2013 | Yu et al. | 439/660 |
| 8,439,708 | B2 * | 5/2013 | Colantuono et al. | 439/660 |
| 8,480,435 | B2 * | 7/2013 | Hsiao et al. | 439/660 |
| 8,523,610 | B2 * | 9/2013 | Kuster | 439/607.01 |

* cited by examiner

*Primary Examiner* — Hien Vu
(74) *Attorney, Agent, or Firm* — Altis Law Group, Inc.

(57) ABSTRACT

An electronic connector having double inserting interfaces includes a housing, two plugs, a connecting unit and a linking element. Each of the plugs has several terminals to form an inserting interface. The linking element is interconnected between the two plugs. The connecting unit includes cross wires comprising several first conductive wire portions and several second conductive wire portions, which respectively spatially correspond to the respective terminals of each of the plugs. When the electronic connector is inserted into a connector socket, one of the plugs protrudes beyond another and enters the connector socket, thereby electrically connects with the contact terminals of the connector socket via its inserting interface and also electrically connects with the another plug, while another plug electrically connects with the corresponding conductive wire portion of the connecting unit. Thus, the orientation for insertion does not need to be considered.

4 Claims, 4 Drawing Sheets

ELECTRONIC CONNECTOR WITH DOUBLE INSERTING INTERFACES BACKGROUND

BACKGROUND

1. Technical Field

The present disclosure relates to electronic connector, particularly to electronic connector having two inserting interfaces.

2. Description of Related Art

A Universal Serial Bus (USB) plug should be inserted into a corresponding socket in a particular orientation, for the purpose of ensuring an inserting interface of the plug and a contact interface in the socket can make contact. If the user does not check the inserting direction and inserts wrongly, the USB plug will not successfully be inserted and may cause damage to the plug and the socket. Since the design of the plug and the socket has this limitation on insertion orientation, a universal connectability between the plug and the socket is needed.

BRIEF DESCRIPTION OF THE DRAWINGS

The components in the drawings are not necessarily drawn to scale, the emphasis instead being placed upon clearly illustrating the principles of an electronic connector with double inserting interfaces. Moreover, in the drawings, like reference numerals designate corresponding parts throughout the several views.

DETAILED DESCRIPTION

The electronic connector of the present disclosure is exemplified by a USB connector in this embodiment. Since the electronic connector has double inserting interfaces, the electronic connector can be inserted into a USB connector socket in any orientation.

Figure 1:
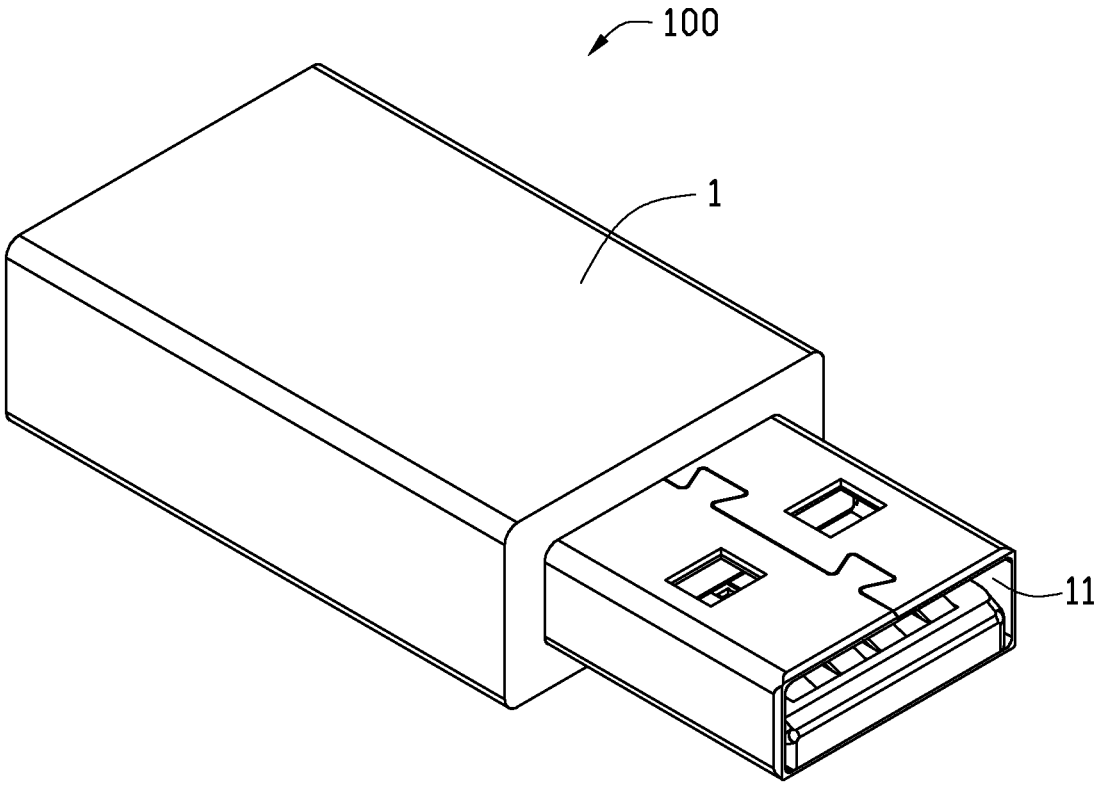
FIG. 1 is a perspective view of an electronic connector with double inserting interfaces of an embodiment of the present disclosure.
Figure 2:
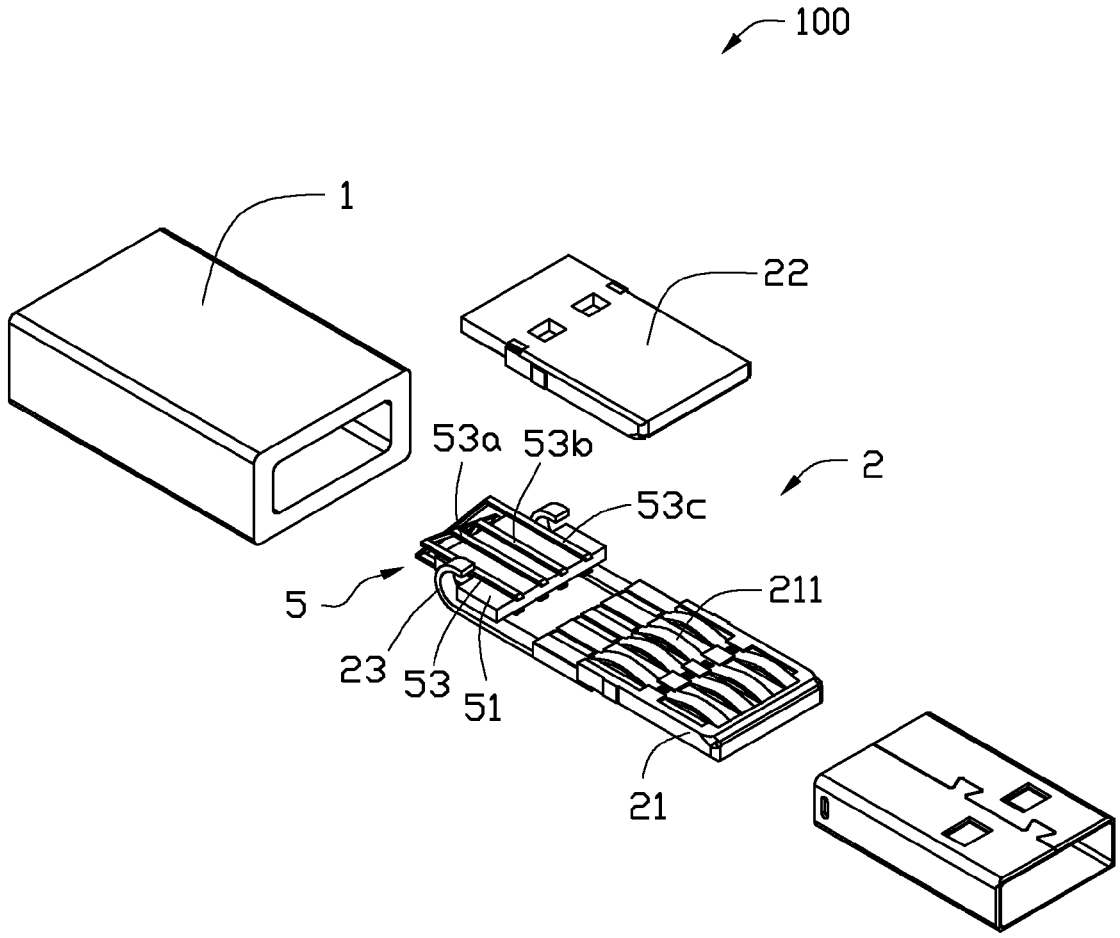
FIG. 2 is an exploded view of the electronic connector with double inserting interfaces of an embodiment of the present disclosure.
Figure 3:
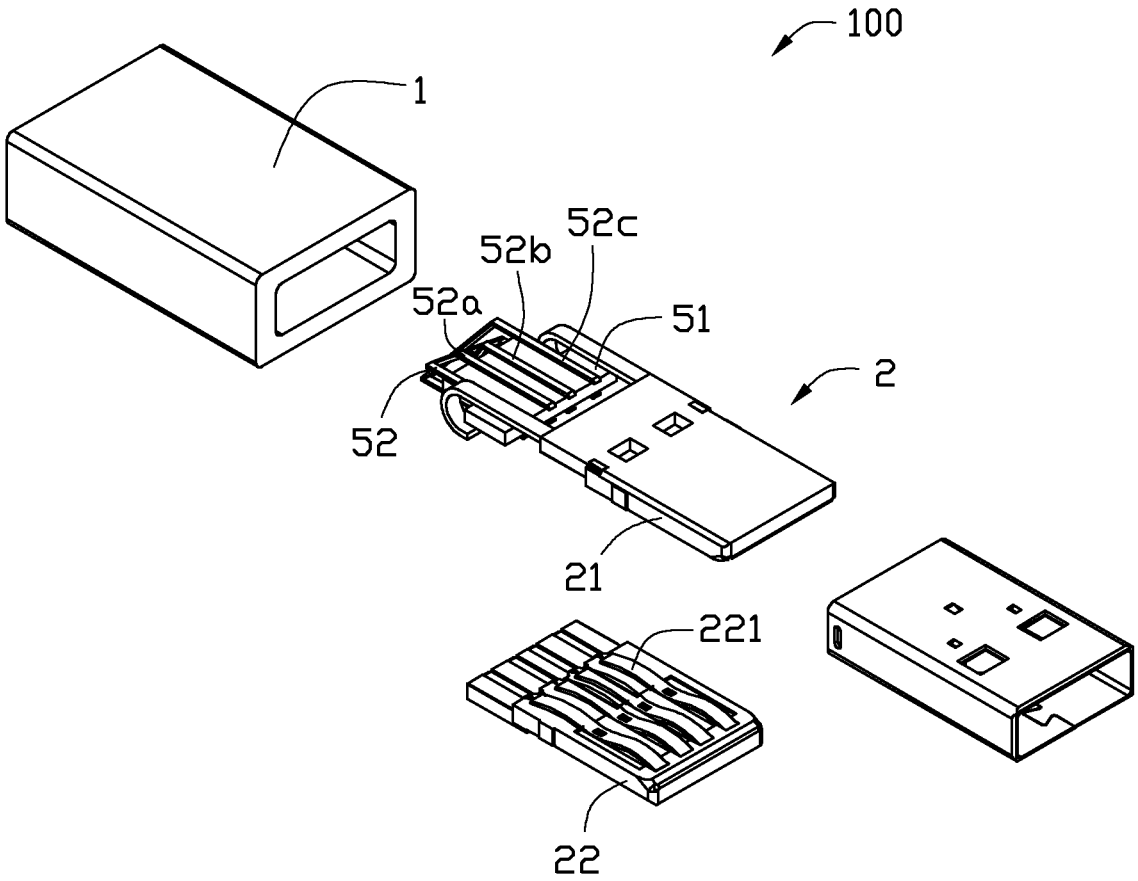
FIG. 3 is an exploded view of the electronic connector with double inserting interfaces of an embodiment of the present disclosure.
Figure 4:
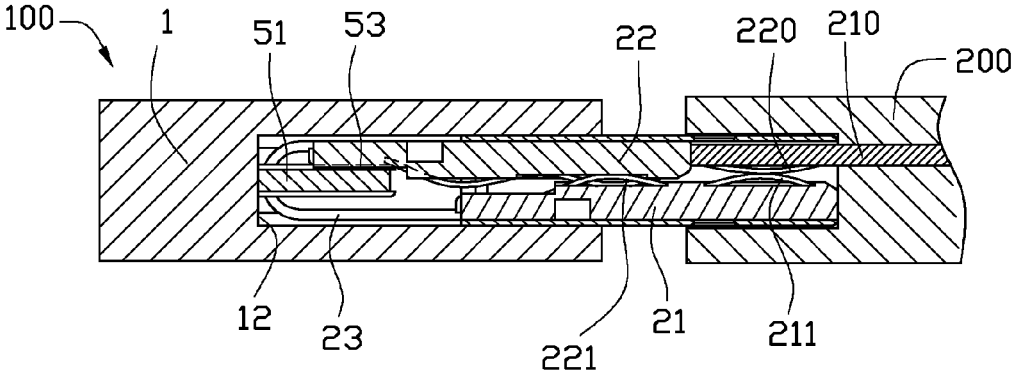
FIG. 4 is a cross-sectional view of the electronic connector with double inserting interfaces of an embodiment of the present disclosure.

Referring to FIG. 1 to FIG. 4, an electronic connector in an embodiment of the present disclosure is shown. The electronic connector 100 has a housing 1. The housing 1 has an insertion face 11 and an elongated cavity sunken from the insertion face 11. Referring to FIG. 4, the cavity has a bottom 12.

Referring to FIG. 2 and FIG. 3, the electronic connector 100 further includes a deformable assembly 2 composed of a first plug 21, a second plug 22 and a linking element 23. The deformable assembly 2 is received in the cavity of the housing 1, while the movement and deformation of the deformable assembly 2 are restricted within the confines of the cavity.

The first plug 21 has several first terminals 211 to form a first inserting interface, and the second plug 22 has several second terminals 221 to form a second inserting interface. The linking element 23 is interconnected between the first plug 21 and the second plug 22, while it is flexible and is substantially non-extendable and non-contractable along a longitudinal axis thereof. In this embodiment, the linking element 23 is composed of two U-shaped pieces, and the first plug 21 and the second plug 22 are respectively connected to an end of each of the U-shaped pieces.

In another embodiment, the linking element 23 is composed of two elastic elements which are springs (not shown). One of the springs is disposed between the first plug 21 and the bottom 12, while the other spring is disposed between the second plug 22 and the bottom 12.

Referring to FIG. 2 and FIG. 3, the electronic connector 100 further includes a connecting unit 5. The connecting unit 5 includes a base 51 and a plurality of crossed wires disposed on the two sides of the base 51. The crossed wires includes a plurality of first conductive wire portions 52 and a plurality of second conductive wire portions 53, wherein the first conductive wire portions 52 are arranged to spatially correspond to the respective first terminals 211, and the second conductive wire portions 53 are arranged to spatially correspond to the respective second terminals 221.

The first conductive wire portions 52 and the second conductive wire portions 53 are cross-wired for a correct connection in any orientation, which means that first conductive wire portion 52 connects to second conductive wire portion 53, first conductive wire portion 52*a* connects to second conductive wire portion 53*a*, first conductive wire portion 52*b* connects to second conductive wire portion 53*b*, and first conductive wire portion 52*c* connects to second conductive wire portion 53*c*.

FIG. 4 is a schematic diagram illustrating how the electronic connector 100 functions with a connector socket 200 of related art. The connector socket 200 has a contact portion 210 and several contact terminals 220 inside, and the contact terminals 220 are disposed on the contact portion 210. The deformable assembly 2 is deformable between a first configuration and a second configuration, which depends on the insertion orientation that the user insert the electronic connector 100 into the connector socket 200.

As shown in FIG. 4, when the electronic connector 100 is inserted as the second plug 22 being aligned to the contact portion 210, the deformable assembly 2 is in the first configuration. Since the second plug 22 is abutted by the contact portion 210, the first plug 21 protrudes beyond the second plug 22 and is insertable into the connector socket 200, thereby the first terminals 211 can connect with the respective contact terminals 220 disposed on the contact portion 210. The second plug 22 is moved inwardly adjacent to the bottom 12 in the cavity. As so, the first terminals 211 are electrically connected with the second terminals 221, and the second terminals 221 are electrically connected with the corresponding second conductive wire portions 53.

If the electronic connector 100 is inserted into the connector socket 200 as the first plug 21 being aligned to the contact portion 210, the deformable assembly 2 will be in the second configuration. When the deformable assembly 2 is in the second configuration, the second plug 22 protrudes beyond the first plug 21 and is insertable into the connector socket 200, thereby the second terminals 221 are connectable to the respective contact terminals 220. The first plug 21 is moved inwardly adjacent to the bottom 12 in the cavity, the first terminals 211 are electrically connected with the second terminals 221, and the first terminals 211 are electrically connected with the corresponding first conductive wire portions 52.

The advantage of such design is that when a user inserts the electronic connector 100 into the connector socket 200, the user need not check the inserting direction, because there are two provided plugs, first plug 21 and the second plug 22. The electronic connector 100 and the connector socket 200 merely require lining up and insertion, without consideration of height sequence of the first plug 21 and the second plug 22.

Although the present disclosure has been specifically described on the basis of this exemplary embodiment, the disclosure is not to be construed as being limited thereto. Various changes or modifications may be made to the embodiment without departing from the scope and spirit of the disclosure.

What is claimed is:

1. An electronic connector comprising:

a housing comprising an insertion face and an elongated cavity defined in the insertion face;

a deformable assembly movably received in the cavity with the movement and deformation of the deformable assembly being restricted within the confines of the cavity;

the deformable assembly comprising:

a first plug having a plurality of first terminals;

a second plug having a plurality of second terminals;

a linking element interconnected between the first plug, and the second plug is flexible and substantially non-extendable;

a connecting unit fixed in the cavity, the connecting unit comprising a plurality of crossed wires, the crossed wires including a plurality of first conductive wire portions arranged to spatially correspond to the respective first terminals; and a plurality of second conductive wire portions arranged to spatially correspond to the respective second terminals;

wherein the deformable assembly is deformable between a first configuration where the first plug protrudes beyond the second plug and is insertable into a connector socket with a plurality of contact terminals therein, thereby the first terminals are connectable to the respective contact terminals, the second plug is moved inwardly adjacent to a bottom in the cavity, the first terminals are electrically connected with the second terminals, the second terminals are electrically connected with the second conductive wire portions, and a second configuration where the second plug protrudes beyond the first plug and is insertable into a connector socket with a plurality of contact terminals therein, thereby the second terminals are connectable to the respective contact terminals, the first plug is moved inwardly adjacent to the bottom in the cavity, the first terminals are electrically connected with the second terminals, the first terminals are electrically connected with the first conductive wire portions.

2. The electronic connector as claimed in claim 1, wherein the linking element is flexible and is substantially non-extendable and non-contractable along a longitudinal axis thereof.

3. The electronic connector as claimed in claim 1, wherein the connecting portion comprises a plate; the first conductive wire portions and the second conductive wire portions are respectively arranged on opposite sides of the plate.

4. The electronic connector as claimed in claim 1, being a USB connector.

* * * * *